US005756970A

United States Patent [19]

Barger et al.

[11] Patent Number: 5,756,970

[45] Date of Patent: May 26, 1998

[54] THERMAL CONVECTION OVEN CONVERSION ALGORITHM

[75] Inventors: James R. Barger, Vandalia, Ohio; Edward C. Groeschel, Lincoln Township, Berrien County, Mich.; Judy K. Anderson, St. Joseph, Mich.; John R. Bentley, Royalton Township, Berrien County, Mich.; Mark W. Baldwin, Lincoln Township, Berrien County, Mich.; Sandra S. Thurlow, Benton Township, Berrien County, Mich.

[73] Assignee: Whirlpool Corporation, Benton Harbor, Mich.

[21] Appl. No.: 433,772

[22] Filed: May 3, 1995

[51] Int. Cl.[6] ..... H05B 1/02

[52] U.S. Cl. ..... 219/506; 219/412; 219/681; 219/719; 219/494; 99/339; 99/325

[58] Field of Search ..... 219/497, 506, 219/505, 494, 681, 706, 410–413, 719; 99/325, 329, 330, 331, 339

[56] References Cited

U.S. PATENT DOCUMENTS

| | | | |
|---|---|---|---|
| 4,255,639 | 3/1981 | Kawabata et al. | 219/506 |
| 4,625,086 | 11/1986 | Karino | 219/10.55 B |
| 4,686,356 | 8/1987 | Ueda et al. | 219/482 |
| 4,687,908 | 8/1987 | Thorne | 219/400 |
| 4,761,539 | 8/1988 | Carmean | 219/497 |
| 5,111,028 | 5/1992 | Lee | 219/506 |
| 5,171,974 | 12/1992 | Koether et al. | 219/506 |
| 5,183,984 | 2/1993 | Nakagawa | 219/506 |
| 5,317,130 | 5/1994 | Burkett et al. | 219/497 |
| 5,321,232 | 6/1994 | Ogle | 219/506 |
| 5,352,874 | 10/1994 | Gong | 219/704 |

*Primary Examiner*—Mark H. Paschall
*Attorney, Agent, or Firm*—Robert O. Rice; Thomas A. Schwyn; Joel M. Van Winkle

[57] ABSTRACT

A method for converting standard conventional oven cook times and temperatures to convection oven cook times and temperatures to operate a thermal convection oven is provided. The method has the steps of providing a thermal convection oven having an oven cavity, a heating element, a control panel for inputting cooking parameters, a converter for converting a standard conventional oven cook time and temperature to a convection oven cook time and temperature, the converter being connected to the input control panel, and having controls connected to the converter and also connected to the heating element for operating the thermal convection oven. Other method steps include: selecting a food type to be prepared using the input control panel, inputting a standard cook time and temperature using the input control panel, converting the standard cook time and temperature to the convection oven cook time and temperature dependent upon the food type selected using the converter; and providing the convection cook time and temperature to the controls to control the heating element. A thermal convection oven is also provided. The thermal convection oven has: a housing with an interior to receive items to be cooked, heating elements within the housing, a control panel for inputting cooking parameters, a converter for converting standard conventional oven cook times and temperatures to a convection oven cook time and temperature; controls for operating the oven connected to the control panel and being responsive to the cooking parameter inputs received from the control panel, the controls being operatively connected to the heating elements to control the temperature of the housing thereby.

19 Claims, 5 Drawing Sheets

THERMAL CONVECTION OVEN CONVERSION ALGORITHM

BACKGROUND OF THE INVENTION

The present invention relates to household appliances, mainly ranges having an oven and more particularly to a thermal convection oven having a conversion algorithm for automatically converting standard oven temperature and time settings to convection settings when an operator programs the oven.

Several types of ranges are available to the consumer today. For example, cook tops, separate ovens, thermal convection ovens and standard ovens are all commonly available. However, most users are only familiar with the standard ovens and their use. Thus, most recipes are written for a standard oven. As result, the temperature and time settings for cooking and baking certain foods are known only for the standard ovens.

However, thermal-convection ovens are capable of cooking foods more rapidly and at lower temperatures than conventional ovens. While this is an added advantage of these ovens in that they save time and energy, it is also a problem. For example, since most of the recipes are written for conventional ovens, the time and temperature settings are inappropriate for the thermal convection ovens. As a result, the consumer would tend to overcook everything in a thermal convection oven and ruin the food. This is, of course, an unacceptable result.

A further disadvantage of the more efficient thermal convection oven is that because of the differences in cooking times and temperatures, the user must convert these values to correspond to appropriate values for use in the thermal convection oven. This is also a time consuming and tedious task that the consumer would rather not undertake. If this step is forgotten or miscalculated, the unacceptable results would again occur.

U.S. Pat. No. 4,687,908 discloses a convection oven wherein the reduction in time and temperature as compared to the operation of a standard oven is discussed. However, this reference makes no mention of conversion categories for the food as in the present invention.

U.S. Pat. No. 4,761,539 discloses a control system for calibrating an oven such that the actual temperature of the oven is varied in relationship to the display temperature setting.

Accordingly, a need has arisen in the area of thermal convection ovens to provide a conversion algorithm that automatically converts the standard oven temperature and time settings for cooking a certain type of food to a proper time and temperature for cooking the food in the thermal convection oven.

SUMMARY OF THE INVENTION

Accordingly, it is an object of the present invention to provide a thermal convection oven conversion algorithm for automatically converting standard oven temperature and time settings to convection temperature and time settings for a specific type of food when an operator programs the convection oven. In performing the conversion, the conversion algorithm of the present invention recognizes three conversions categories of foods: baked goods, meats and other food. The operator selects between these categories and inputs the standard settings for time and temperature. The control conversion algorithm makes the appropriate conversions for optimal convection oven operation.

It is an advantage of the present invention to provide a thermal convection oven conversion algorithm for converting the standard oven temperature and time settings to convection settings automatically based on food type when the user inputs the standard settings. The advantage lies in the convenience for the user and the added advantage of proper cooking without any extra effort on the user's part.

Another advantage of the present invention is to provide a thermal convection conversion algorithm that is simple to use for a user.

DESCRIPTION OF THE PREFERRED EMBODIMENTS

Figure 1:
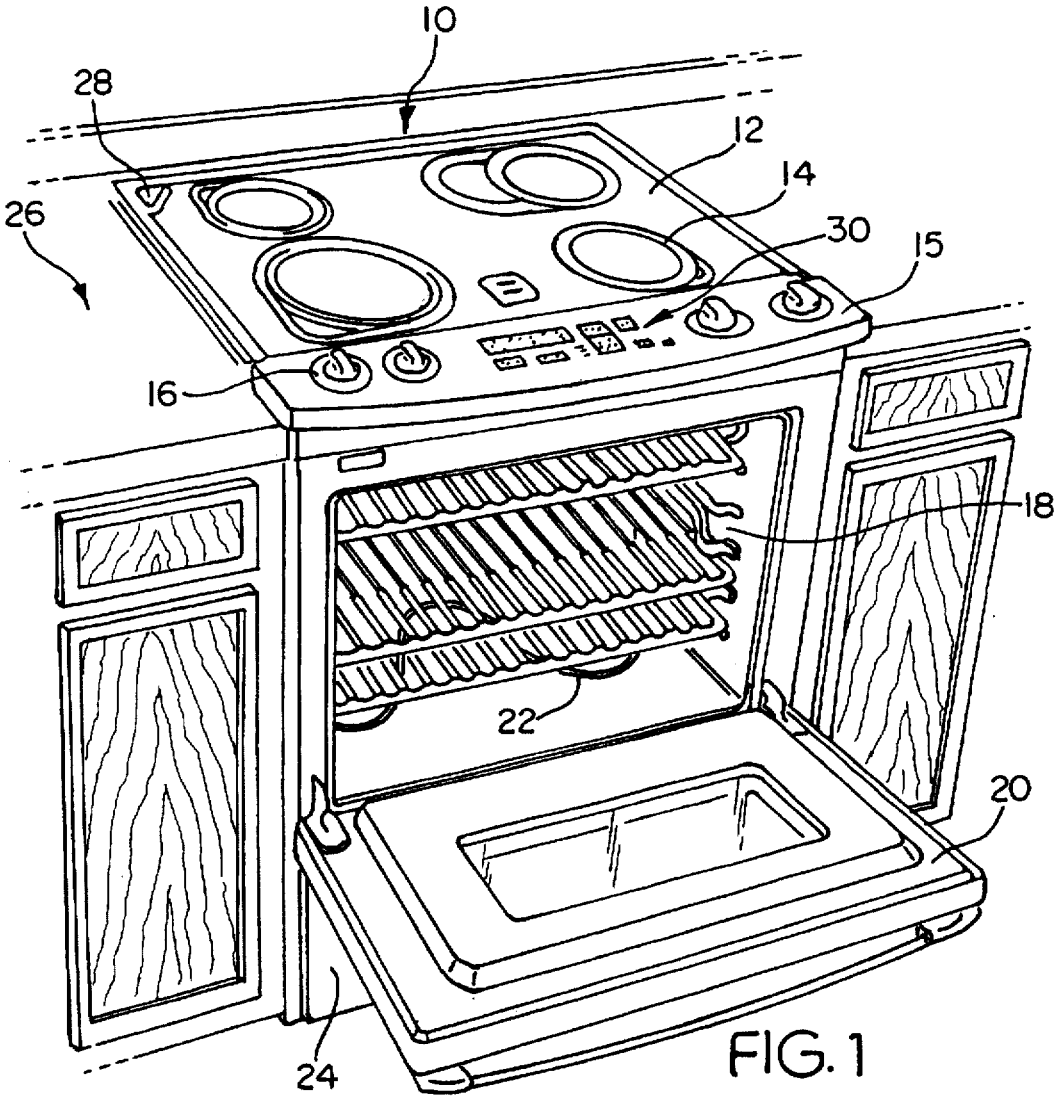
FIG. 1 is a perspective view of an appliance illustrating a range having a control panel with which the thermal convection oven conversion algorithm of the present invention can be utilized.

FIG. 1 illustrates an appliance generally at 10 which shows a range. The range 10 has a cooktop surface 12 having a plurality of burners 14 and a control panel 15. The control panel 15 provides cooktop control knobs 16 for controlling the burners 14 on the cooktop surface 12. The range 10 also provides an oven cavity 18 for baking and broiling food. The range 10 also has an oven door 20. FIG. 1 shows the range with the oven door 20 in an open position. The open oven door 20 exposes the oven cavity 18 and a heating element 22 therein. A storage drawer 24 is provided beneath the oven cavity 18. Also shown is a counter top 26. The cooktop surface 12 is flush with the counter top 26.

Another feature of the cooktop surface 12 is an oven vent 28 located near the rear of the cooktop surface 12. Toward the front of the cooktop surface 12 is the control panel 15 which further has an electronic oven control 30 for controlling the oven cavity 18. The electronic oven control 30 is further described below with reference to FIG. 2.

Figure 2:
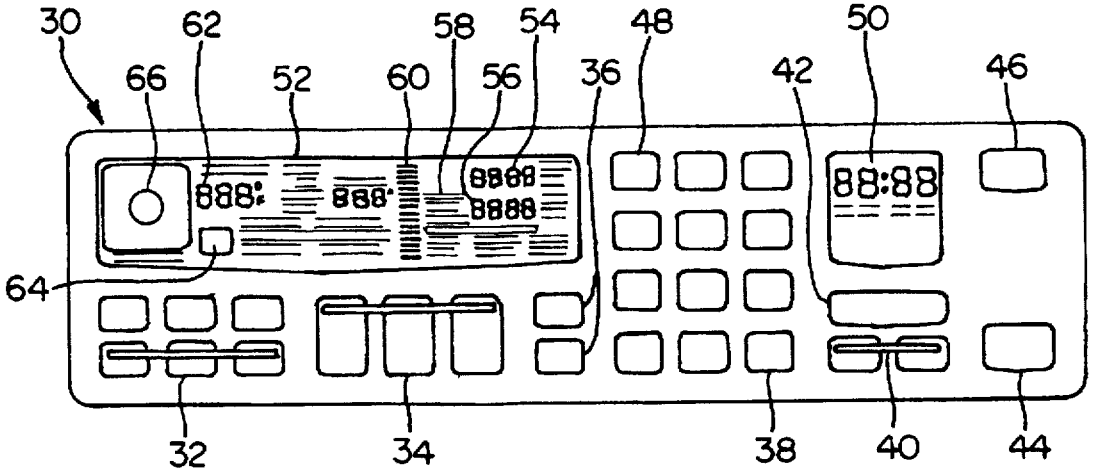
FIG. 2 is a plan view of an electronic oven control of the present invention.

FIG. 2 illustrates the electronic oven control 30 of the present invention. As shown, the electronic oven control 30 has a multitude of pads and displays thereon to provide a convenient interface for a user when cooking foods using the thermal convection oven. In a preferred embodiment, the plurality of pads are membrane switch pads, which allow a clean, flush appearance and simple use. Also, vacuum fluorescent displays are preferred. Beginning in the lower left corner of the electronic oven control 30 and continuing in a counter-clockwise direction, a brief description of the components of the electronic oven control 30 will now be described.

The electronic oven control 30 provides oven setting pads 32 for choosing between convection and standard cooking and baking. In addition, convection conversion pads 34 are also provided. The convection conversion pads 34 include three separate pads for selecting settings appropriate to the types of food to be prepared, including: baked goods, meats, and other foods. Also provided are timed and delayed cooking pads 36, an oven light pad 38 and timer pads 40. For convenience, a clock set-start pad 42 is also provided.

In addition, the electronic oven control 30 provides a cancel/off pad 44 and a start pad 46. Also, number pads 48 having digits 0–9 are also provided for inputting numerical values for cooking temperatures and times.

Moreover, the electronic oven control 30 provides a time of day/timer display 50 and an oven display 52. The timer display 50 and the oven display 52 provide valuable information to the user of the convection oven. For example, the oven display 52 has digital readouts of several oven-related variables and indicators. For example, a digital start time 54 and digital stop time 56 are provided. Also provided is a check food indicator 58 for instructing a user when to check on the food to see if it is done cooking.

A bar graph indicator 60 has a number of segments in a vertical column to graphically display relative values of cook time savings. A digital temperature readout 62 provides the user with the temperature of the oven cavity 18. Also, an ON indicator 64 is provided so that the user knows the oven is on. Finally, an oven indicator 66 symbolically shows which elements of the oven cavity 18 are active at a certain time, for example whether convection is operating or standard conventional operation is being used. When a user desires to prepare food in a range 10 as shown in FIG. 1 having an electronic oven control 30 as shown in FIG. 2, the user follows certain steps to assure proper cooking or baking of the food.

Figure 3:
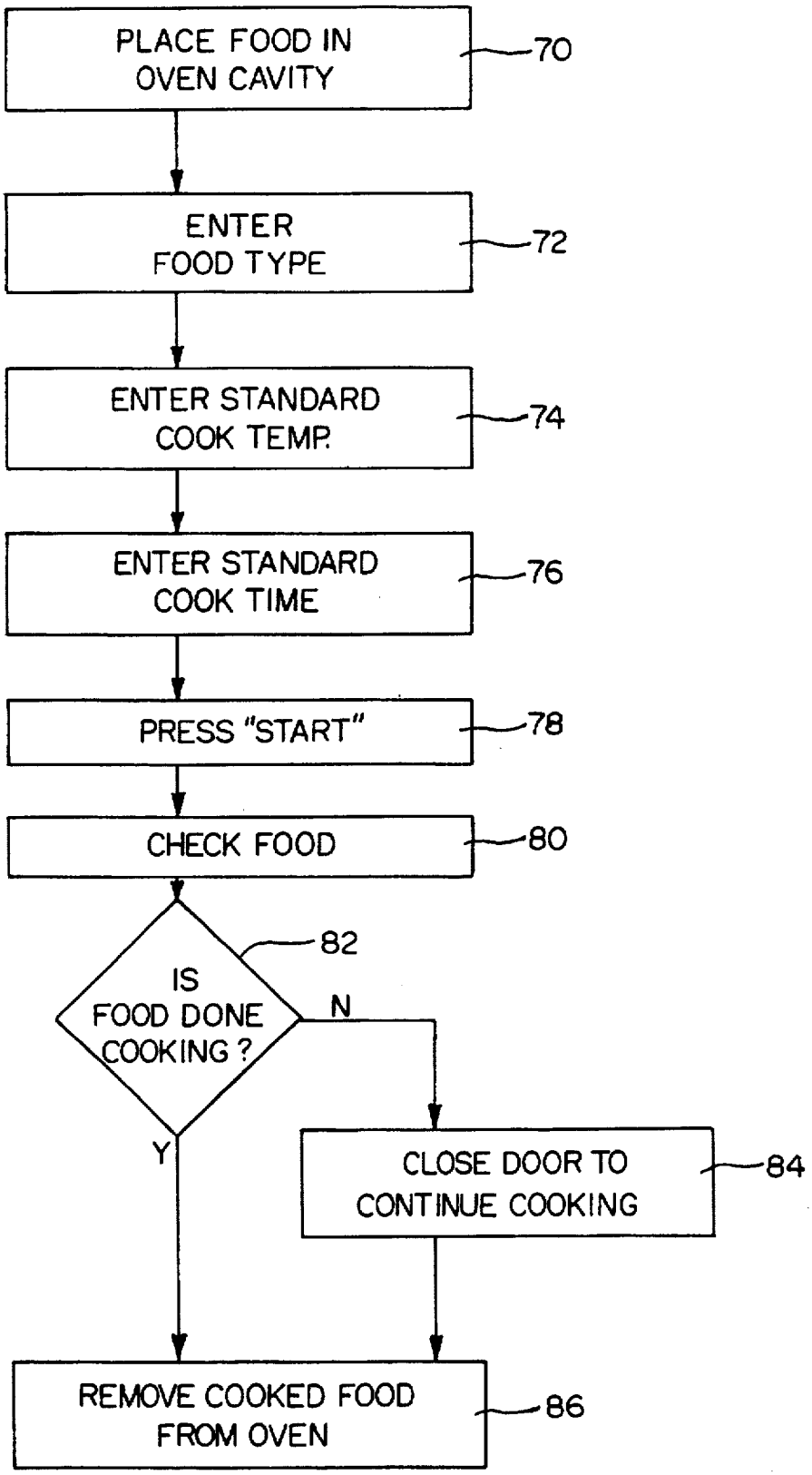
FIG. 3 is a flowchart of user operation for cooking food using an oven having the thermal convection conversion algorithm of the present invention.

FIG. 3 illustrates a flowchart of the user operation steps that are necessary to properly cook food in a thermal convection oven having the conversion algorithm of the present invention. As illustrated in FIG. 3, first, in step 70 the user places the food in the oven cavity 18. The next step 72 is to enter the food type to be prepared. This is done by selecting one of the convection conversion pads 34 on the electronic oven control panel 30. Thus, the food may be a baked good, a meat or other food item. Next, in step 74, the user enters the standard cook temperature for the food item according to the recipe for a conventional oven. This is done by pressing number pads 48 in the proper order to arrive at the cook temperature which will then be displayed on the oven display 52. The user must then also enter the standard cook time in step 76 as listed in a recipe for a conventional oven. This is similarly performed by using the number pads 48 to enter the cook time. The cook time will also be displayed on the oven display 52. Once these steps are performed, the user presses the start pad 46 in step 78 to begin cooking. At the expiration of the prescribed cook time, the check food indicator 58 will illuminate on the oven display 52 as shown in step 80. The user may then check the food in step 82 to see if it is done cooking. If the food is not done cooking, the user simply closes the oven door 20 as indicated in step 84 so that the oven will continue to cook. When, however, the food is done cooking, the user may press the cancel pad 44 to turn off the range 10 and remove the food from the oven as shown in step 86.

A primary advantage of the present invention is that by selecting one of the convection conversion pads 34 thereby selecting the food type to be prepared, and inputting the standard temperature and time for cooking with the number pads 48, the convection conversion algorithm of the present invention will perform a conversion based upon the user inputs to convert the standard cook times and temperatures to converted cook times and temperatures and display the converted cook times and temperatures on the oven display 52.

Figure 4:
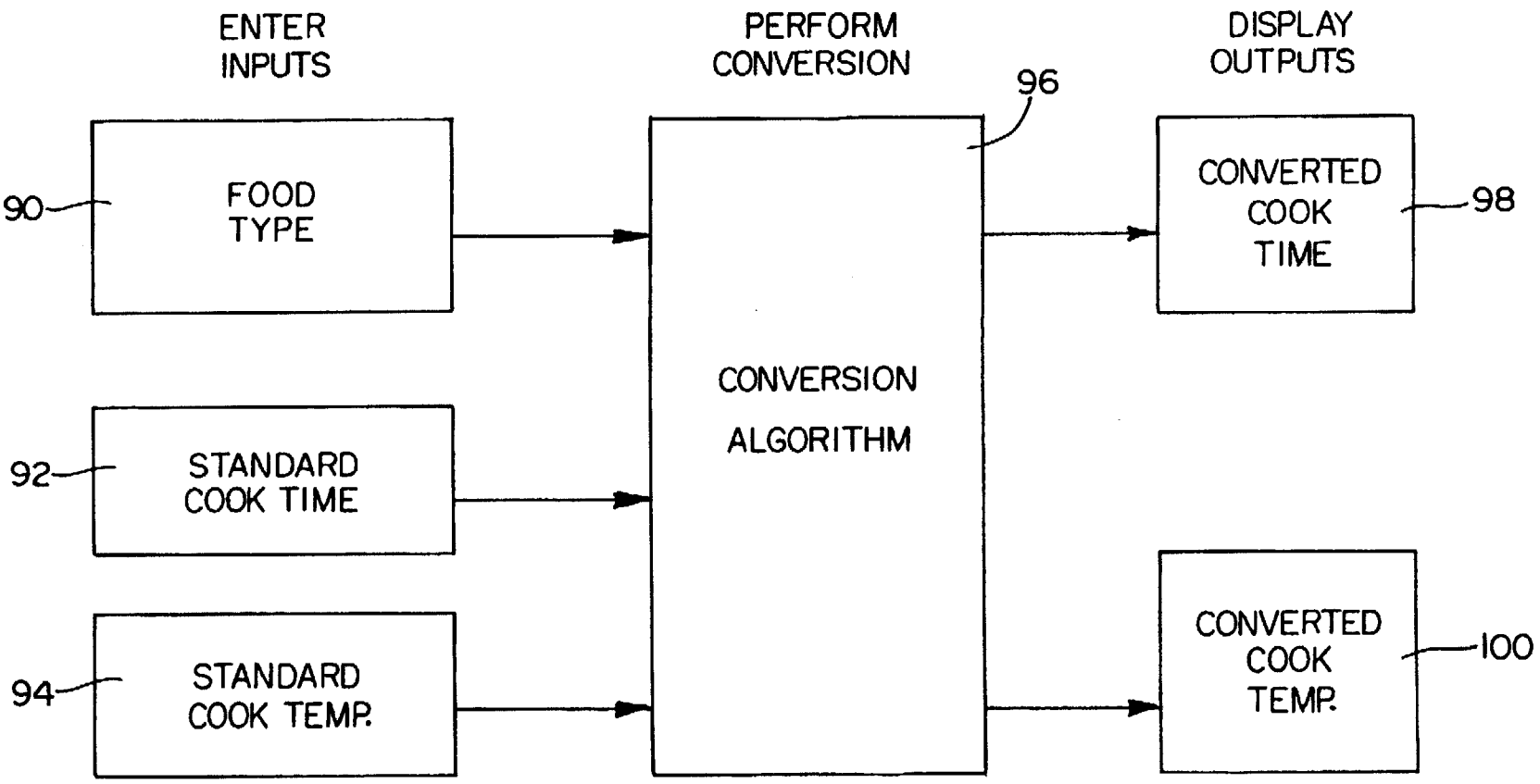
FIG. 4 is a flowchart showing the inputs necessary and the output display generated by performing the thermal convection conversion algorithm of the present invention.

FIG. 4 illustrates the manner in which the conversion is carried out. As can be seen, the inputs are entered, including conversion food type 90, standard cook time 92 and standard cook temperature 94. The conversion algorithm is then performed in step 96 to convert these times and temperatures to converted cook times 98 and converted temperatures 100 which are proper for the thermal convection oven. The converted temperatures are usually 50° F. less for baked goods and 25° F. less than standard cook temperatures for meats and other foods. The converted times for baked goods are approximately the same, whereas the converted times for meats are about 15% less than standard and for other foods are usually 10% less than standard. Also, these converted times and temperatures are displayed on the oven display 52. The bar graph indicator 60 graphically displays the reduction of time from standard to convection and as the food cooks, the bar graph decrements to show the calculated time remaining for cooking.

As is apparent from the foregoing specification, the invention is susceptible of being embodied with various alterations and modifications which may differ particularly from those that have been described in the specification. It should be understood that we wish to embody within the scope of the patent warranted hereon, all such modifications as reasonably and properly come within the scope of our contribution to the art.

The embodiments of the invention in which an exclusive property or privilege is claimed are therefore defined as follows:

1. A method for converting standard conventional oven cook times and temperatures to convection oven cook times and temperatures to operate a thermal convection oven, the method comprising the steps of:

providing a thermal convection oven having an oven cavity, heating means for increasing the temperature in the oven cavity, means for inputting cooking parameters and food types, means for converting a standard conventional oven cook time and temperature to a convection oven cook time and temperature, the converting means being connected to the input means, and having control means connected to the converting means and also connected to the heating means for operating the thermal convection oven;

selecting a food type to be prepared using the input means;

inputting a standard conventional oven cook time and a standard conventional oven cook temperature using the input means;

converting the standard conventional oven cook time and temperature to the convection oven cook time and temperature, dependent upon the food type selected, using the converting means; and providing the convection oven cook time and temperature to the control means to control the heating means thereby providing proper convection oven operation.

2. The method of claim 1, wherein the thermal convection oven further has display means, the method further comprising the step of:

displaying the convection time and temperature using the display means.

3. The method according to claim 2, further comprising the step of:

graphically displaying a time savings via the display means, said time savings resulting from converting the standard conventional oven cook time to the convection oven cook time.

4. A thermal convection oven, comprising:

a housing having an interior constructed and arranged to receive items to be cooked within the housing;

heating means within the housing wherein the heating means increases the temperature of the interior of the housing;

means for inputting conventional cook time and temperature, the inputting means having an output representing the conventional cook time and temperature;

means for converting the conventional cook time and temperature to a convection oven cook time and temperature wherein the converting means is connected to the input means and receives the output of the inputting means; and control means for operating the thermal convection oven connected to the converting means and being responsive to the converted convection oven cook time and temperature, the control means being operatively connected to the heating means to control the temperature in the housing thereby.

5. The thermal convection oven of claim 4, wherein the control means includes a microprocessor.

6. The thermal convection oven of claim 4, wherein the means for inputting conventional cook time and temperature further comprises:

a symbolic display graphically representing the heating means of the thermal convection oven.

7. The thermal convection oven of claim 4, wherein the means for inputting conventional cook time and temperature further comprises:

a bar graph indicative of a time savings resulting from the conversion of the standard conventional oven cook time to the convection oven cook time.

8. The thermal convection oven of claim 4, wherein the means for inputting conventional cook time and temperature further comprises:

at least one digital display.

9. The thermal convection oven of claim 4, wherein said means for inputting conventional cook time and temperature further comprises:

at least one vacuum fluorescent display.

10. The thermal convection oven of claim 4, wherein the means for inputting conventional cook time and temperature further comprises:

a plurality of membrane switches.

11. A thermal convection oven of claim 4, wherein the means for inputting conventional cook time and temperatures further comprises:

means for inputting a conventional oven cook time, a conventional cook temperature and a food type.

12. The thermal convection oven of claim 4, wherein the converting means further comprises:

a look-up table means.

13. The thermal convection oven of claim 4, wherein the control means further comprises:

control software to operate the oven.

14. The thermal convection oven of claim 4, wherein the conversion means further comprises:

software means having a look-up table of conversion values.

15. A thermal convection oven of claim 4, wherein the converting means further includes means for selecting a food type wherein the conversion of the conventional cooking parameters to convection oven cook time and temperature is dependent upon the food type selected.

16. A thermal convection oven of claim 4, wherein the converting means further includes means for selecting between baked goods and meats wherein the conversion of the conventional cooking parameters to convection oven cook time and temperature is dependent upon the selection between baked goods and meats.

17. A thermal convection oven of claim 16, wherein the converting means reduces the input cook temperature by approximately 50° F. when baked goods is selected.

18. A thermal convection oven of claim 16, wherein the converting means reduces the input cook temperature by approximately 25° F. and reduces the input cook time by at least 10% when meats is selected.

19. A method for effectively cooking foods using standard conventional oven cooking parameters with a convection oven having a convection conversion algorithm and means for inputting cooking parameters, a method comprising the steps of:

placing the food to be prepared in the oven;

entering the food type using the means for inputting cooking parameters;

entering the standard conventional oven cook temperature using the means for inputting cooking parameters;

entering the standard conventional oven cook time using the means for inputting cooking parameters;

pressing a start button on the means for inputting cooking parameters; checking the food at the end of a converted cook time;

continue cooking the food until done; and removing the cooked food from the oven.

* * * * *

UNITED STATES PATENT AND TRADEMARK OFFICE

CERTIFICATE OF CORRECTION

PATENT NO. : 5,756,970

DATED : 5/26/98

INVENTOR(S) : Barger et al.

Figure 2A:
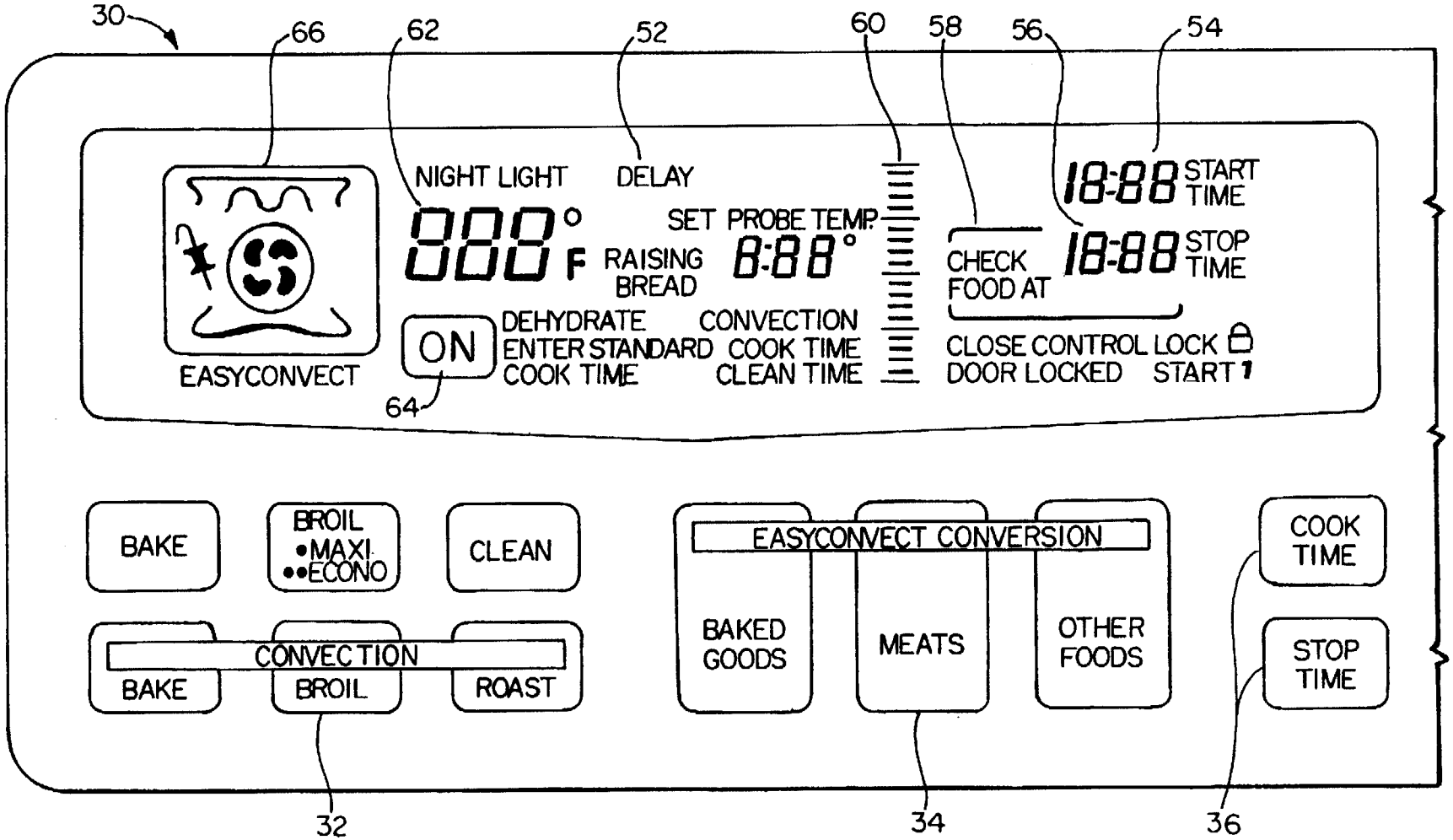

It is certified that error appears in the above-identified patent and that said Letters Patent is hereby corrected as shown below:

Column 2, after line 18 insert:

--Figure 2a is an enlarged view of the left-hand portion of the electronic oven control of Fig.2 showing greater detail thereof.--

Figure 2B:
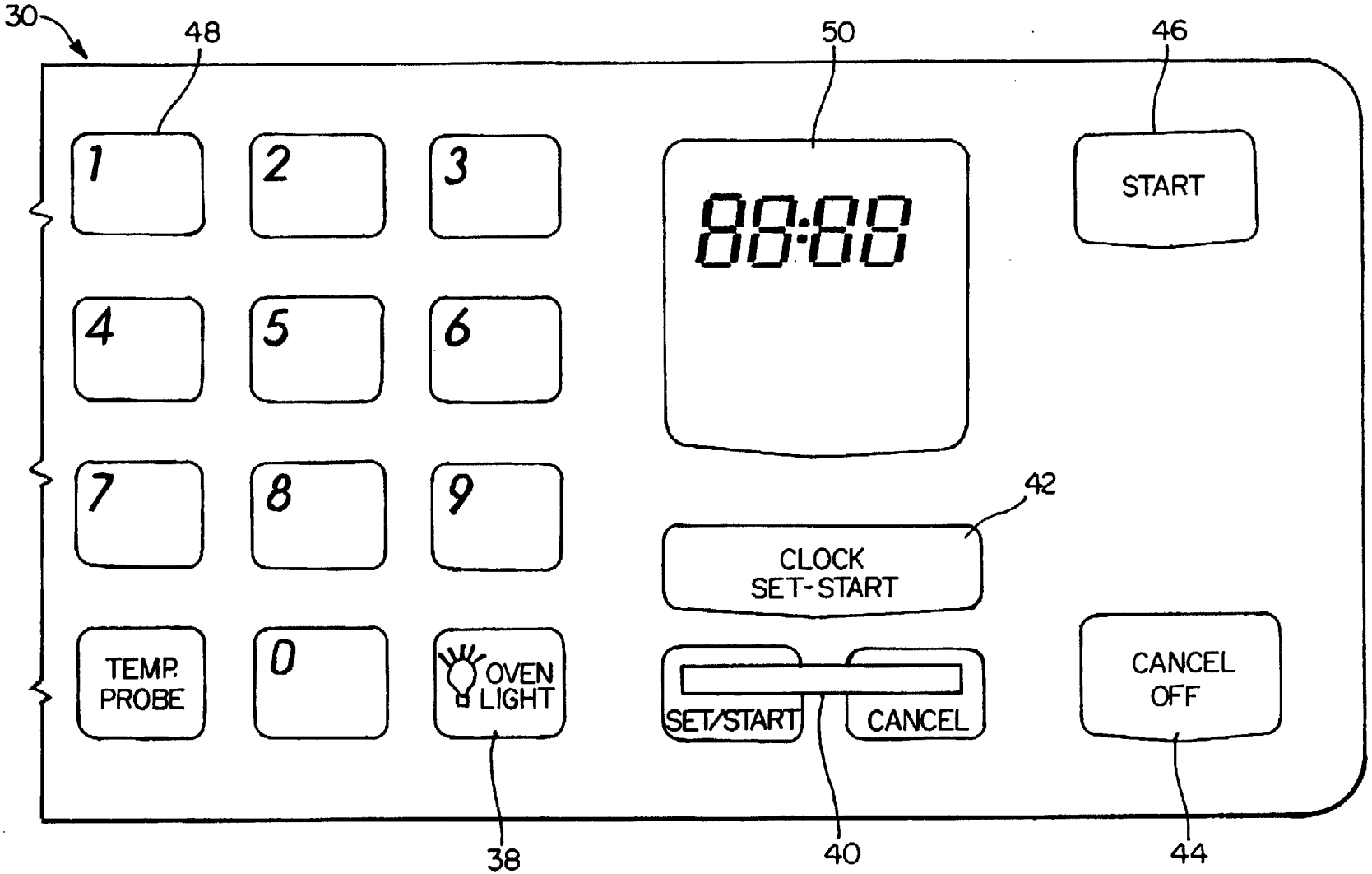

Figure 2b is an enlarged view of the right-hand portion of the electronic oven control of Fig. 2 showing greater detail thereof.--

Signed and Sealed this

Ninth Day of February, 1999

*Attest:*

*Acting Commissioner of Patents and Trademarks*

*Attesting Officer*